United States Patent [19]

du Pont

[11] 4,311,004

[45] Jan. 19, 1982

[54] GAS COMPRESSION SYSTEM AND METHOD

[75] Inventor: Anthony A. du Pont, Los Angeles, Calif.

[73] Assignee: Rotoflow Corporation, Los Angeles, Calif.

[21] Appl. No.: 88,648

[22] Filed: Oct. 26, 1979

[51] Int. Cl.[3] ..... F04D 29/10

[52] U.S. Cl. ..... 60/39.05; 415/175

[58] Field of Search ..... 60/39.02, 39.05; 415/175, 176

[56] References Cited

U.S. PATENT DOCUMENTS

| | | | |
|---|---|---|---|
| 3,420,434 | 11/1969 | Swearingen | 415/176 |
| 3,452,839 | 7/1969 | Swearingen | 62/193 |
| 3,670,850 | 6/1972 | Swearingen | 184/6.23 |

FOREIGN PATENT DOCUMENTS

| | | | |
|---|---|---|---|
| 1197932 | 1/1957 | France | 415/175 |
| 938820 | 10/1963 | United Kingdom | 415/175 |

OTHER PUBLICATIONS

Zimmermann, F. J., *New Waste Disposal Process,* Chemical Engineering, Aug. 25, 1958.

*Primary Examiner*—Louis J. Casaregola

*Attorney, Agent, or Firm*—Browning, Bushman & Zamecki

[57] ABSTRACT

A system and method are disclosed for processing an oxygen-containing gas for use in a chemical process producing a generally inert gas. A fluid handling rotor is carried by a rotary shaft for effecting a pressure change in the oxygen-containing gas. A housing surrounds the rotor and the adjacent portion of the shaft. A bearing, axially spaced from the rotor, supports the shaft in the housing for rotation. Lubricant is injected into the bearing and is caused to flow through the bearing and axially toward the rotor. A seal surrounds the shaft intermediate the rotor and the bearing and seals between the shaft and housing. A generally inert seal gas is extracted from the products of the chemical process and injected into the seal under a pressure greater than the pressures within the housing on either side of and immediately adjacent the seal.

25 Claims, 2 Drawing Figures

GAS COMPRESSION SYSTEM AND METHOD

BACKGROUND OF THE INVENTION

1. Field of the Invention

Various chemical processes such as processes for the oxidation of waste material, utilize an oxygen-containing gas, such as air, at relatively high pressure. The air may be compressed by a centrifugal compressor including a rotor mounted on a shaft. A housing surrounds the rotor and the adjacent portion of the shaft, and bearings are provided to support the shaft in the housing for rotation. Typically, a liquid lubricant is continuously injected into the bearings, flows through the bearings and is drained from the housing for re-injection. The lubricant flows through the bearings in both axial directions; thus a portion of the lubricant for the bearing closest to the compressor rotor will flow axially toward the rotor. At the same time, a certain amount of the air being compressed inevitably leaks from the area between the rotor and housing toward the adjacent bearing. Since the lubricant is combustible and may be at least partially atomized, and the air or other oxygen-containing gas being handled by the compressor is at an elevated pressure, it is particularly important to prevent intermingling of the lubricant and air so as to avoid possible explosion.

Accordingly, a seal may be provided surrounding the shaft intermediate the rotor and the adjacent bearing and sealing between the shaft and housing. However, in many instances it is desirable to use a seal such as a labyrinth seal which is designed to permit a certain amount of leakage therethrough. In any event, regardless of the type of seal used, it may be impossible to completely eliminate leakage across the seal. Thus, additional precautions are desirable.

2. Description of the Prior Art

Prior U.S. Pat. Nos. 3,937,022, 3,831,381, 3,670,850, 3,452,839 and 3,420,434 all disclose the general concept of injecting a seal gas to separate the lubricant and process fluid of a rotary fluid handling machine such as a turboexpander or compressor. More specifically, such a seal gas is injected into a seal located between the bearings and the rotor of such a machine under a sufficient pressure to prevent intermingling of the process fluid and lubricant. However, since such seal gas then typically becomes intermingled with both the process fluid being handled by the rotor and the lubricant being circulated through the bearings, new problems are introduced. In general, the seal gas must be chosen such that it will be compatible with both of the other fluids in the sense that it will not react with these fluids or their constituents or otherwise interfere with their proper functions. Also, it is usually necessary, at least as to the lubricant, that the seal gas be easily separable therefrom before recycling the lubricant. In many such prior art systems, suitable seal gases are readily available. For example, in many such systems a relatively inexpensive seal gas, obtained from an outside source, may be compatible with both the process fluid and the lubricant. In other systems, such as those disclosed in U.S. Pat. Nos. 3,937,022 and 3,831,381, the rotary device being sealed is a turboexpander which may be handling, for example, hydrocarbons. In such cases, a seal gas may be obtained from the process fluid itself.

However, in systems in which air or another oxygen-containing gas is being compressed, or otherwise processed, the problem of finding a suitable seal gas becomes more difficult. Not only must the seal gas be compatible with the air or process fluid and also with the lubricant, but it must also be incapable of supporting combustion and virtually fool-proof in maintaining complete separation of the air and lubricant. In general, in such systems an inert gas is desirable. However, obtaining a suitable inert gas, such as nitrogen, from an outside source or extracting it from the air being compressed would be unduly costly.

SUMMARY OF THE INVENTION

The present invention contemplates the extraction of a suitable generally inert seal gas such as nitrogen from the products of the chemical process in which the air or other oxygen-containing gas is being used. For example, one exemplary process is an oxidation process utilizing compressed air and producing a pressurized gaseous product stream comprised primarily of water vapor and nitrogen with some carbon dioxide. Since this product stream is obtainable from the situs of the oxidation process at a relatively high pressure, it can be expanded in turboexpanders or the like for driving the compressors which compress the air for use in that process. Nitrogen, which is a nearly ideal seal gas for a compressor being used to compress air or the like, and having a hydrocarbon lubricant for its bearings, is obtained from the product stream. More specifically, a portion of the product stream may be extracted and passed through a separator which removes such components as water, e.g. by cooling and condensation, leaving only the nitrogen and perhaps some carbon dioxide. The latter gas, while still under pressure, may then be injected into the seal between the compressor rotor and its adjacent bearing. Extracting the seal gas from the waste product stream in this manner is particularly advantageous since it is possible to extract the gas at a pressure sufficiently high for the sealing purpose thus eliminating the expense of actively compressing the seal gas.

For example, in a typical system, several compression-expansion stages may be employed, the stages operating at successively lower overall pressures. Each stage would include at least one turboexpander and at least one compressor driven thereby. The first or highest pressure stage would have its turboexpander receiving the gaseous product stream directly from the situs of the oxidation process and its compressor delivering compressed air thereto. The turboexpander of the first stage would deliver the gaseous product stream partially expanded therein to the intake of the expander of the next lower stage. Conversely, the compressor of the first stage would receive partially compressed air from the next lower stage. Subsequent stages would be similarly connected. Thus, to obtain seal gas for the first stage, a portion of the gaseous product stream from the oxidation process may be extracted at a point upstream of the expander of the first stage, the generally inert seal gas separated therefrom, and delivered to the seal of the compressor of the first stage. For subsequent stages, a portion of the gaseous product stream may be extracted from within the next higher pressure expander or from a point between that expander and the expander of the stage in question, the inert seal gas separated therefrom and delivered to the seal of the compressor of that stage. This technique insures that the seal gas being used at each stage is at a sufficiently high pressure to flow axially in both directions through the seal and separate the air being compressed from the combustible lubricant.

Where, as in the example given above, the seal gas is a generally inert gas such as nitrogen, the presence of trace amounts thereof in the air being compressed will not effect the proper functioning of the air in the oxidation process. Likewise, such a gas not only will not react with the lubricant but may be easily separated therefrom by simply discharging the mixed or intermingled lubricant and seal gas from the portion of the housing between the bearing and the seal to a disengagement chamber where the gas, being substantially lighter than the lubricant, will rise to the top of the chamber while the liquid lubricant settles to the bottom. The lubricant can then be removed from the chamber by a first outlet and recycled through the bearings, while the disengaged seal gas may be removed from a separate outlet and discharged. By providing a choke in the outlet for the seal gas, the rate of discharge of seal gas from the disengagement chamber may be controlled. Since this chamber is in open communication with the portion of the housing from which the lubricant and seal gas are being drained, this will also automatically control the rate of injection of seal gas into the seal.

Accordingly, it is a principal object of the present invention to provide an improved system and method for sealing a system for processing air or other oxygen-containing gases.

Another object of the present invention is to provide such a system and method in which the seal gas is a generally inert gas extracted from the products of a chemical process in which the compressed gas is being used.

Still another object of the present invention is to provide such a system and method including a plurality of compression-expansion stages operating at successively lower overall pressures and separate seal gas extraction means for each stage for extracting gas at a pressure suitable for that stage.

Still another object of the present invention is to provide such a system and method including means for automatically controlling the rate of injection of seal gas into the seal.

Still other objects, features, and advantages of the present invention will be made apparent by the following description of a preferred embodiment, the drawings, and the claims.

DESCRIPTION OF THE PREFERRED EMBODIMENTS

Figure 1:
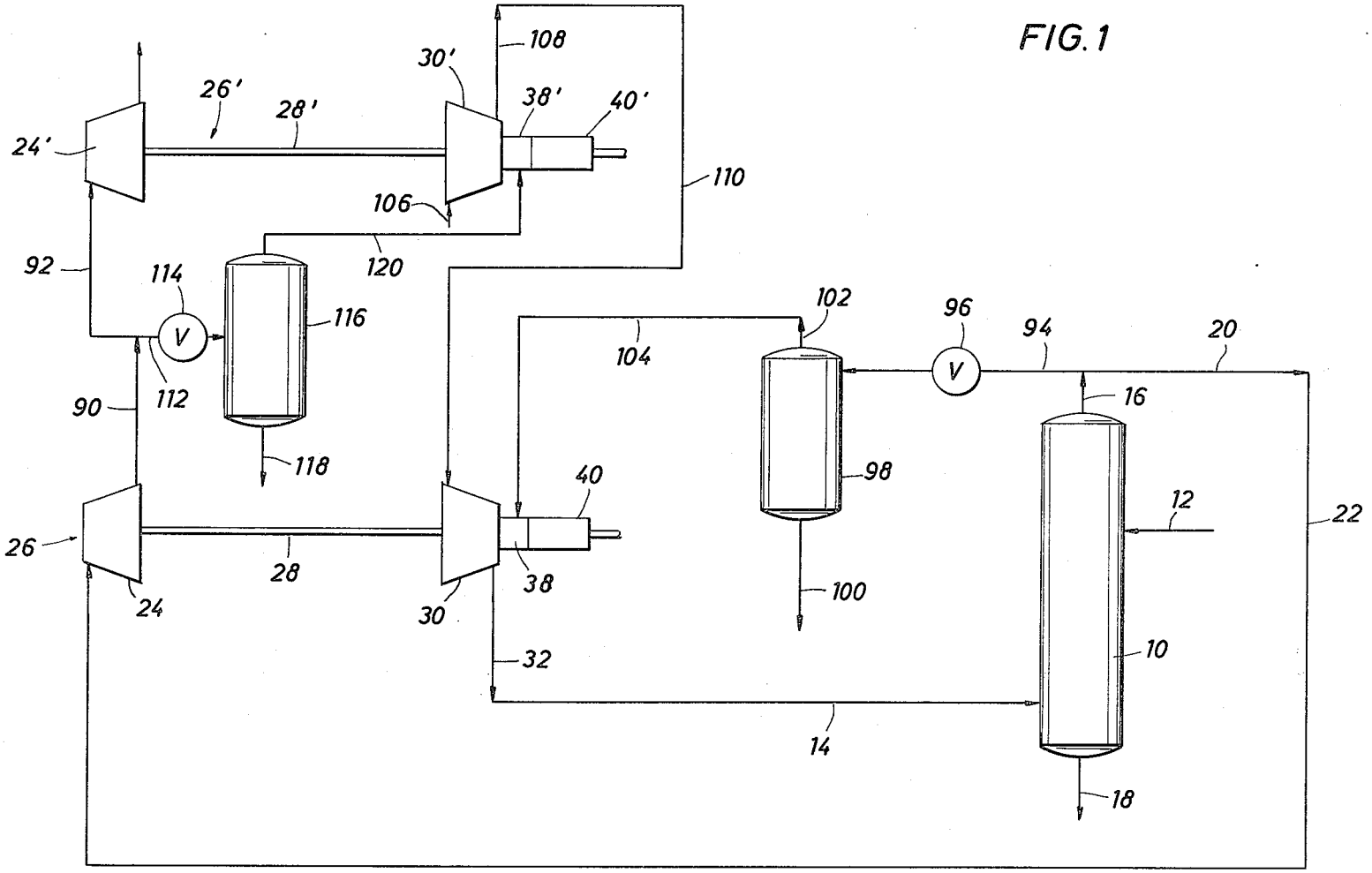
FIG. 1 is a flow diagram illustrating a simplified system according to the present invention.

Referring to FIG. 1, 10 represents a pressure chamber which is the situs of an aqueous, high pressure oxidation process. More specifically, the chemical process performed in chamber 10 oxidizes waste organic materials in aqueous solution or suspension using air at about 3000 psi and at least about 500° F. (275° C.). The primary products of the oxidation process are water vapor, carbon dioxide and the residual nitrogen from the air, the total mols in the gaseous product stream being about twice that of the air used in the process. The waste material to be oxidized, in aqueous solution or suspension, is introduced into chamber 10 by line 12. The compressed air is introduced to chamber 10 through line 14. The gaseous product stream including water vapor, nitrogen, and carbon dioxide, is removed from the upper end of chamber 10 through line 16. Other liquid and/or solid products of the oxidation process may be removed from chamber 10 by line 18.

The gaseous product stream exiting chamber 10 through line 16 is under a relatively high pressure. Such pressure is substantially maintained as the gaseous product stream is directed through lines 20 and 22 to the intake of a turboexpander 24 of a first compression-expansion stage 26. Stage 26 further includes a shaft 28 rotatably driven by turboexpander 24 as it expands the gaseous prouct stream passing therethrough, and a compressor 30, the rotor of which is mounted on shaft 28 so as to be driven thereby. Compressor 30 is used to compress air for use in the oxidation process occuring in chamber 10. Accordingly, the outlet of compressor 30 communicates through lines 32 and 14 with chamber 10.

Figure 2:
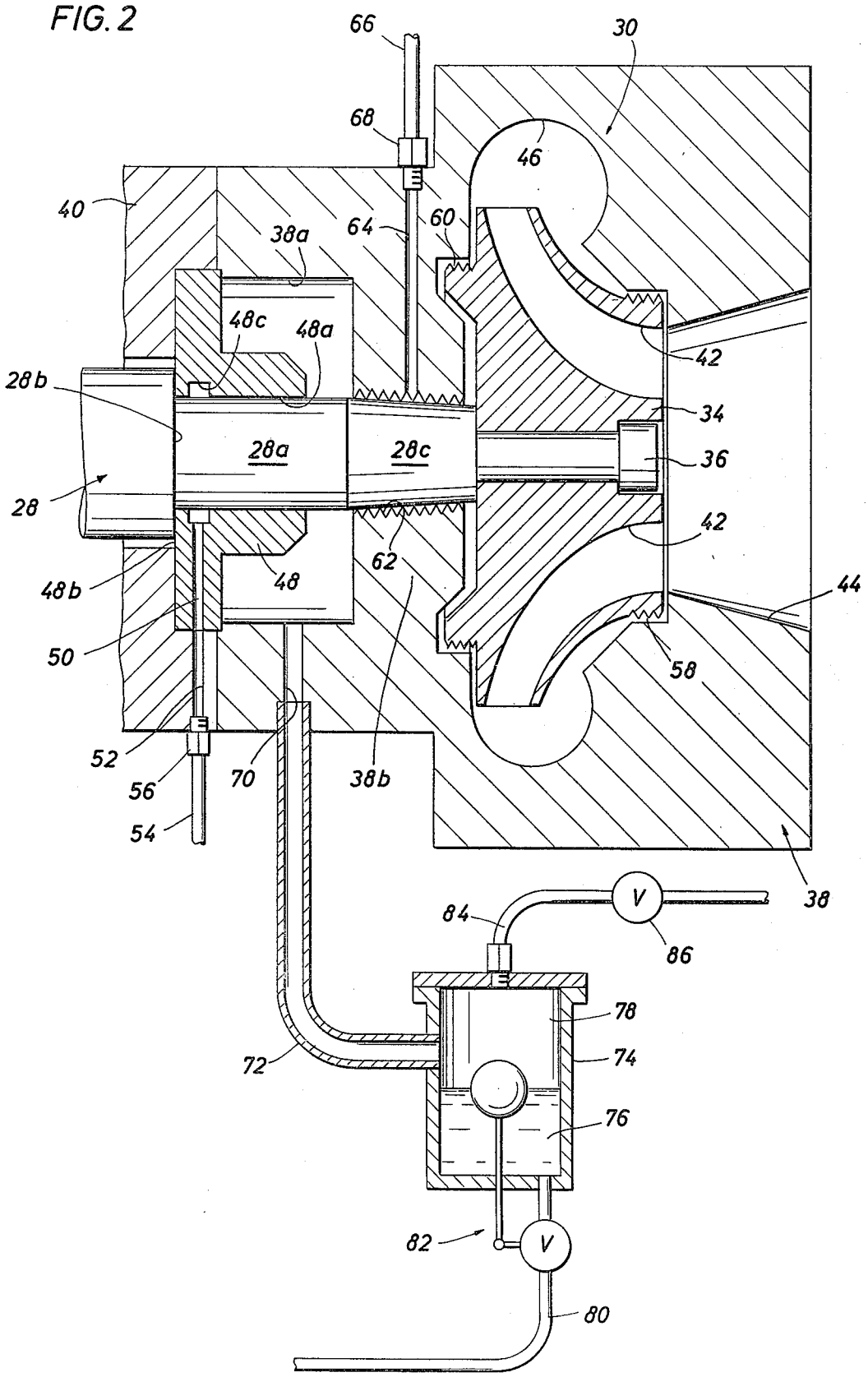
FIG. 2 is an enlarged longitudinal cross-sectional view showing one of the compressors and the adjacent bearing means and disengagement chamber.

Compressor 30 and the adjacent parts are shown in greater detail in FIG. 2. In particular, the compressor includes a rotor 34 which is mounted on the end of shaft 28 by a screw 36. A housing 38 surroudns rotor 34 and the immediately adjacent portions of shaft 28, the remainder of the adjacent portions of shaft 28 being surrounded by a housing 40 continuous with and rigidly affixed to housing 38. Rotor 34 has a plurality of passageways 42 therethrough each having an inlet opening generally axially through rotor 34 into the intake or inlet 44 of housing 38. Each passageway curves axially inwardly and radially outwardly from its inlet end to a generally radially outwardly directed outlet communicating with an annular volute 46 in housing 38. Volute 46 is continuous with the outlet (not shown) of housing 38. Thus, as air enters the inlet 44, it passes into the passages 42 of rotor 34 being rotated by shaft 28. The gas is thus compressed and caused to flow radially outwardly by centrifugal force through passages 42 and into volute 46 and ultimately out through the housing outlet.

A pair of annular lubricated bearings are rigidly affixed within housing means 38, 40 to support shaft 28 for rotation therein. One such bearing is shown at 48 in FIG. 2. Bearing 48 is axially spaced from rotor 34 and has a radially inwardly facing generally cylindrical surface **48*a* which closely surrounds a relatively small diameter cylindrical section 28*a* of shaft 28 to support the shaft for rotation. Bearing 48 also has an axially directed face 48*b* which opposes an axially facing shoulder 28*b* formed on shaft 28 between small diameter section 28*a* and the adjacent larger diameter section. Surfaces 48*b* and 28*b* provide thrust bearing for thrust in a first axial direction. A second bearing (not shown) which is the mirror image of bearing 48, would be spaced further from rotor 34 than bearing 48 and would further support shaft 28 for rotation while also providing for thrust bearing in the opposite axial direction from that accommodated by bearing 48**.

Radial bearing surface **48*a* has an annular groove 48*c* therein. Communicating with groove 48*c* is a radial bore 50 extending outwardly through bearing 48 and communicating with a similar bore 52 in housing 40. A conduit 54 is connected to housing 40 in communication with bore 52 by a suitable threaded connector 56. A liquid combustible lubricant, such as a suitable oil, is pumped through line 54, bore 52, and bore 50 into groove 48*c* and thus distributed about the entire circumference of the adjacent part of shaft 28**. The pump pressure by which the lubricant is thus supplied to groove 48c causes the lubricant to flow axially outwardly from that groove coating bearing surfaces 48a and 48b. This simultaneously lubricates the radial and thrust bearings and also provides a pressure seal preventing communication between the portions of the housings 40 and 38 on axially opposite sides of bearing 48. Accordingly, a portion of the lubricant flowing through the bearing will flow axially toward rotor 34 and enter area 38a of housing 30 which is located generally axially between bearing 48 and rotor 34.

At the same time, a small portion of the air being compressed by rotor 34 will leak into the spaces between the sides of the rotor and the opposed surfaces of housing 38. Although the opposite axial ends of rotor 34 are sealed with respect to housing 38 by annular labyrinth type seals 58 and 60, these seals are designed to permit a small amount of leakage therethrough. Air leaking through seal 58 presents no problem since it will be entrained in the incoming air and re-enter rotor passages 42. However, air leaking through seal 60 will enter the area behind the closed or large end of rotor 34 whence it cannot re-enter passages 42 but, on the contrary, can at least potentially flow into housing area 38a and mingle with the lubricant therein. Due to the high pressure of such air, and to the fact that the lubricant in area 38a of the housing may be at least partially in the form of a mist, such intermingling of the air and lubricant poses a serious danger of explosion. To prevent such intermingling, housing 38 has a radially inwardly extending flange 38a which closely surrounds a conical section 28c of shaft 28 intermediate bearing section 28a and rotor 34. The radially inwardly facing surface of flange 38b as shown in generally tapered to correspond to the tapering of shaft section 28c (although in other embodiments it could be straight) and further has labyrinth seal formations 62 thereon.

A radial bore 64 extends through housing 38 and flange 38b intermediate the axial extremities of labyrinth seal formations 62. A conduit 66 is connected to housing 38 in communication with bore 64 by a fitting 68. A generally inert seal gas, extracted from the gaseous product stream being discharged from chamber 10 (see FIG. 1) in a manner to be discribed more fully below, is injected through conduit 66 and bore 64 into labyrinth seal formations 62 at a pressure greater than those prevailing within housing 38 on axially opposite sides of seal 62, i.e. a pressure greater than that prevailing in the housing area 38a as well as the area between flange 38b and the back of rotor 34. Accordingly, the seal gas will flow around the shaft and thence axially in both directions into housing area 38a and also into the area between flange 38b and the back of rotor 34 thereby effectively preventing intermingling of compressed air and lubricant within housing 38.

As will be explained more fully below, the inert seal gas in the exemplary embodiment presently being described is comprised primarily of nitrogen and a small amount of carbon dioxide. The term "generally inert" as used herein will mean that the gas in question includes one or more elements or compounds which are nonreactive with one another and each of which will neither react with nor otherwise interfere with the proper functioning of either the gas being compressed by the compressor or the lubricant. Thus, in the present example, the term "generally inert gas" would include both nitrogen, which is truly inert, as well as carbon dioxide and mixtures of those two gases. More specifically, both nitrogen and carbon dioxide are components of air. Neither of them will react with air, and the small amounts of seal gas which may enter the oxidation process along with the air being compressed will not sufficiently dilute the oxygen in that air so as to interfere with the oxidation process. Likewise, neither nitrogen nor carbon dioxide will react with the oil lubricant. Furthermore, since the oil used as a lubricant will generally be in liquid form under the pressure prevailing in space 38a, while nitrogen and carbon dioxide are normally in gaseous form at such pressures, the seal gas which mingles with the lubricant in housing area 38a may be easily separated from the lubricant so that the latter may be recycled through the bearings.

More specifically, housing 38 has a drain opening 70 therethrough communicating with area 38a. A conduit 72 communicates with the outer end of opening 70 to direct lubricant and seal gas from housing area 38 into a disengagement chamber 74. In chamber 74, the lubricant settles as indicated at 76, while the seal gas rises to the upper portion 78 of the chamber. Lubricant is removed from chamber 34 through a first outlet system including a conduit 80 communicating with the bottom of the chamber and controlled by a float-valve arrangement 82. Seal gas is removed from chamber 34 through an outlet system including a conduit 84 communicating with the upper end of chamber 74. Choke means 86, which may be in the form of a throttling valve, an orifice plate, or the like, limits the rate of flow of seal gas from chamber 74. Since chamber 74 is in open communication with housing area 38a via conduit 72 and opening 70, this automatically controls the volumetric flow rate of seal gas through bore 64 into seal 62, and out of the bearing side of seal 62. Furthermore, most of the seal gas from line 66 enters the space behind rotor 34, passes through seal 60 and into discharge 46 of the compressor to be returned, pressurized, to the chemical process whence it originated. Thus, by selecting and/or adjusting valve 86 to allow little or no gas flow through line 84 to the suction or inlet 44 of the compressor, seal gas flow may be maintained without the application of external power.

As previously mentioned, the generally inert seal gas is obtained by extraction from the gaseous product stream from the oxidation process. Referring again to FIG. 1, and as mentioned above, the oxidation process occuring in chamber 10 results in a high pressure gaseous product stream comprised primarily of water vapor, nitrogen, and carbon dioxide, and in some cases, trace amounts of oxygen. The major portion of the gaseous product stream is directed by lines 16, 20, and 22 to expander 24 where it is partially expanded producing powet to drive the rotor of compressor 30 via shaft 28. The partially expanded gaseous product stream from expander 24 is in turn directed by lines 90 and 92 to the intake of the turboexpander 24' of a second compression-expansion stage 26', also including a compressor 30'. The gaseous product stream is further expanded in expander 24' to drive shaft 28' and thereby drive compressor rotor 30'. While the bulk of the pressurized gaseous product stream from the oxidation process is thus used to power the compressors 30 and 30', a portion of the gaseous product stream is extracted through line 94 at a point upstream of the highest pressure expander 24, and preferably, at or near its point of discharge from chamber 10 where it exists at its highest pressure. A valve 96 is disposed in line 94 to control the volume and rate of extraction of gas from the main gaseous product stream. The gas extracted by line 94 is directed thereby into a separator 98. There the extracted portion of the gaseous product stream is cooled, preferably to near ambient temperature, while maintaining substantially its original pressure, so that the water vapor portion thereof is condensed and may be removed by line 100. This leaves a pressurized gas comprising mostly nitrogen and a small amount of carbon dioxide. As explained above, such a gas is suitable for use as a seal gas for injection into the seal 62 between the rotor of compressor 30 and the next adjacent bearing. This gas may also include trace amounts of oxygen, but these would be insufficient to pose any danger of combustion and would be otherwise compatible with and separable from the lubricant. Also, the fact that such gas was extracted upstream of expander 24, and its pressure substantially maintained during the separation process occuring in separator 98, insures that the gas exists at a pressure sufficient to cause it to flow in both axial directions along shaft 28 thereby preventing intermingling of the air being compressed by compressor 30 and the lubricant being circulated through the bearings. Accordingly, the substantially inert gas produced in separator 98 is directed by lines 102 and 104 through compressor housing portion 38 and seal 62 with the results described hereinabove.

As previously mentioned, the system disclosed in FIG. 1 includes a second compression-expansion stage 26' which is substantially identical to stage 26 except that it has a lower overall operating pressure. By this is meant that expander 24' operates at lower pressures than the expander 24 of the next adjacent stage, its compressor 30' operates at pressures lower than those of the next adjacent compressor 30, etc. Accordingly, the pressure necessary for a seal gas to effectively prevent intermingling of the air being handled by compressor 30' and the lubricant in its bearings is less than that needed to achieve the same results with respect to compressor 30. At this point, it is noted that compressor 30' of the second stage 26' takes in air from any appropriate source at 106 and partially compresses it, the partially compressed air being directed by lines 108 and 110 to the intake of compressor 30 of stage 26.

To obtain an appropriate seal gas for sealing between the rotor and next adjacent bearing associated with compressor 30', a small portion of the gaseous product stream is extracted by line 112 at a point intermediate expanders 24 and 24' (although the gas could theoretically be extracted from a point within expander 24). A valve 114 is provided on line 112 to control the rate and amount of gas so extracted. Line 112 directs the extracted portion of the gaseous product stream into a separator 116 which is substantially identical to separator 98 except that it is operated at a lower pressure. More specifically, separator 116 cools the extracted portion of the gaseous product stream while maintaining it at substantially the same pressure at which it was extracted from lines 90 and 92. This causes the water vapor portion of the gaseous product stream to condense so that it may be removed at 118. The remaining nitrogen and carbon dioxide are directed by line 120 into housing portion 38' of compressor 30', and more specifically, into and through the seal provided between the compressor rotor and the next adjacent bearing. The pressure of such seal gas, having been maintained at substantially the same pressure at which it was extracted upstream of the expander 24' of the stage in question, will be sufficient to accomplish the sealing function as described hereinabove.

It can thus be seen that, in its most preferred forms, the present invention not only makes use of the products of the oxidation process for which compressed air is being used to provide a seal gas for the compressor, but, in a multi-stage system, extracts seal gas for each stage at a respective appropriate pressure thereby insuring proper sealing without the necessity for unnecessarily expensive high pressure separators in the lower pressure stages of the system.

It can also be appreciated that numerous modifications of the exemplary system described and shown herein may be made without departing from the spirit of the invention. For example, while in the simplified system shown, each compression-expansion stage includes only a single expander and a single compressor, in actual practice it might be desirable to drive two or more compressors from a single turboexpander in each stage. Likewise, whereas only two stages are shown in FIG. 1 for the sake of simplicity, it should be understood that any number of stages of successively lower overall operating pressure could be employed, each stage having its expander receiving the gaseous product stream from the next higher stage and its compressor delivering partially compressed air to the compressor of the next higher pressure stage. Of course, the lowest pressure stage in any system would have its compressor intake communicated to atmosphere or to any other suitable external source of air or other oxygen-containing gas, and its expander outlet communicated to atmosphere or to a suitable storage means.

Likewise, while the invention has been described in conjunction with a particular type of oxidation process, numerous other oxidation processes, such as those for the preparation of combustible synthetic gas, as well as chemical processes other than oxidation processes, may require compressed air or other oxygen-containing gas and may yield products offering a convenient source of a substantially inert seal gas for the compressors, and the present invention could be adapted for any such process. Accordingly, in connection with some such processes, modifications may be made in the means for extracting a suitable generally inert seal gas from the gaseous product stream. In particular, in some systems the separation may include treatment other than or in addition to the cooling described above.

Modifications could also be made in the seal means into which the seal gas is injected. As shown in FIG. 2, formations 62 constitute the seal means. These formations may be viewed as a single labyrinth type seal or as two sections of labyrinth separated by bore 64. In any event, the seal gas is injected at a point intermediate the axial extremities of the seal means (formations 62) as a whole. Thus, as used herein injection of a gas "into seal means" will be construed to include both injection into a single elongate seal and injection between two seals and without regard to the type of seal involved.

Finally, while the basic principles of the invention are particularly useful in sealing compressor rotors and have been described in that context, they may be applied to the sealing of rotors of other types of fluid handling devices such as turboexpanders. Still other modifications will suggest themselves to those of skill in the art. Accordingly, it is intended that the scope of the present invention be limited only by the claims which follow.

I claim:

1. A gas compression system for processing a first gas for use in a process producing a gaseous product stream, said system comprising:

a plurality of stages operating at successively lower overall pressures, each of said stages including:

at least one fluid handling compressor impeller carried by a rotary shaft for compressing said first gas;

expander means for expanding said gaseous product stream and drivingly connected to said compressor impeller;

housing means generally surrounding said compressor impeller and the adjacent portion of said shaft;

bearing means axially spaced from said compressor impeller and supporting said shaft in said housing means for rotation;

means for injecting lubricant into said bearing means and causing said lubricant to flow through said bearing means and axially toward said compressor impeller;

seal means surrounding said shaft intermediate said compressor impeller and said bearing means and sealing between said shaft and said housing means;

means for extracting a seal gas inert to said lubricant from said gaseous product stream;

and means for injecting said seal gas into said seal means under a pressure greater than the pressure within said housing between said seal means and said bearing means;

a first of said stages having its compressor outlet communicating with the situs of said process and its compressor intake communicating with the compressor outlet of a second stage of lower overall operating pressure, said first stage further having its expander intake communicating with the situs of said process at a location to receive said gaseous product stream and its expander outlet communicating with the expander intake of said second stage;

and said gas extraction means for said first stage being adapted to extract a portion of said gaseous product stream at a point upstream of the expander of said first stage and separate said seal gas therefrom, and said gas extraction means for said second stage being adapted to extract a portion of said gaseous product stream at a point within or downstream of the expander of said first stage but upstream of the expander of said second stage and separate said seal gas therefrom.

2. The system of claim 1 wherein said first gas is an oxygen-containing gas, wherein said process is a chemical process, wherein said seal gas is generally inert, and wherein said gaseous product stream produced by said chemical process is pressurized.

3. The system of claim 2 wherein said seal gas injecting means is adapted to inject said seal gas under a pressure greater than the pressure within said housing on either side of and immediately adjacent said seal means.

4. A gas compression system for processing a first gas for use in a process producing a gaseous product stream, said system comprising:

a fluid handling impeller carried by a rotary shaft for compressing said first gas;

housing means generally surrounding said impeller and the adjacent portion of said shaft;

bearing means axially spaced from said impeller and supporting said shaft in said housing means for rotation;

means for injecting lubricant into said bearing means and causing said lubricant to flow through said bearing means and axially toward said impeller;

seal means surrounding said shaft intermediate said impeller and said bearing means and sealing between said shaft and said housing;

means for extracting a seal gas inert to said lubricant from said gaseous product stream;

and means for injecting said seal gas into said seal means under a pressure greater than the pressure within said housing between said seal means and said bearing means;

wherein said housing means has a drain opening disposed axially between said bearing means and said seal means;

said system further comprising a disengagement chamber communicatively connected to said drain opening for receipt of lubricant and seal gas from said housing means, said disengagement chamber having first outlet means associated therewith for removing lubricant therefrom and second outlet means associated therewith for removing seal gas therefrom, said second outlet means communicating with the inlet of said impeller.

5. The system of claim 4 wherein said first gas is an oxygen-containing gas, wherein said process is a chemical process, and wherein said seal gas is generally inert.

6. A method of compressing a first gas for use in a process producing a gaseous product stream, comprising the steps of:

operating a plurality of stages at successively lower overall pressures, the operation of each of said stages including:

passing said first gas through a compressor impeller carried by a rotary shaft to compress said first gas;

injecting lubricant into bearing means axially spaced from said compressor impeller and supporting said shaft in a housing and causing said lubricant to flow through said bearing means and axially toward said compressor impeller;

extracting a seal gas inert to said lubricant from said gaseous product stream;

injecting said seal gas into seal means surrounding said shaft intermediate said compressor impeller and said bearing means under a pressure greater than the pressure within said housing between said seal means and said bearing means;

and expanding said gaseous product stream in an expander drivingly connected to said compressor impeller;

said gaseous product stream being directed from the situs of said process to the expander of a first of said stages for partial expansion, and the gaseous product stream expanded in said first stage being directed to the expander of a second stage of lower overall operating pressure for further expansion;

partially compressing said first gas by passage through the compressor impeller of said second stage, and directing the first gas compressed in said second stage to the compressor impeller of said first stage for further compression, and directing the first gas compressed in said first stage to the situs of said process;

extracting a portion of said gaseous product stream at a point upstream of the expander of said first stage, separating said seal gas therefrom and injecting it into the seal means of said first stage;

and extracting a portion of said gaseous product stream at a point within or downstream of the expander of said first stage, separating said seal gas therefrom and injecting it into the seal means of said second stage.

7. The method of claim 6 wherein said first gas is an oxygen-containing gas, wherein said process is a chemical process, wherein said seal gas is generally inert, and wherein said gaseous product stream produced by said chemical process is pressurized.

8. The method of claim 7 wherein said seal gas is injected into each of said seal means under a pressure greater than the pressure within the respective one of said housings on either side of and immediately adjacent said seal means.

9. A method of compressing a first gas for use in a process producing a gaseous product stream comprising the steps of:

passing said first gas through a compressor impeller carried by a rotary shaft to compress said first gas;

injecting lubricant into bearing means axially spaced from said compressor impeller and supporting said shaft in a housing and causing said lubricant to flow through said bearing means and axially toward said compressor impeller;

extracting a seal gas inert to said lubricant from said gaseous product stream;

injecting said seal gas into seal means surrounding said shaft intermediate said compressor impeller and said bearing means under a pressure greater than the pressure within said housing between said seal means and said bearing means;

removing lubricant and seal gas from a portion of said housing between said bearing means and said seal means;

disengaging said seal gas from said lubricant in a chamber;

recycling said lubricant through said bearing means;

removing said disengaged seal gas from said chamber through outlet means;

and communicating said outlet means with the inlet of said compressor rotor.

10. The method of claim 9 wherein said first gas is an oxygen-containing gas, wherein said process is a chemical process, and wherein said seal gas is generally inert.

11. The method of claim 10 wherein said gaseous product stream produced by said chemical process is pressurized.

12. The method of claim 11 wherein said seal gas is injected into said seal means under a pressure greater than the pressure within said housing on either side of and immediately adjacent said seal means.

13. The system of claim 1 wherein said gas extraction means comprises means for cooling said portion of said gaseous product stream to condense constituents other than said generally inert gas.

14. The system of claim 4 further comprising flow restriction means in said second outlet means for limiting the rate of removal of seal gas from said disengagement chamber and thereby controlling the rate of injection of seal gas into said seal means.

15. The method of claim 10 further comprising expanding said gaseous product stream to produce power and utilizing such power to drive said compressor rotor.

16. The method of claim 15 wherein said extraction includes extracting a portion of said gaseous product stream at a point upstream of the situs of said expansion and separating said generally inert gas therefrom.

17. The method of claim 16 wherein said separation of said generally inert gas includes cooling said portion of the gaseous product stream to condense constituents other than said generally inert gas.

18. The method of claim 17 wherein said gaseous product stream includes nitrogen and water vapor.

19. The method of claim 18 wherein said gaseous product stream also includes carbon dioxide.

20. The method of claim 7 wherein said oxygen-containing gas is air and said chemical process is an oxidation process.

21. The method of claim 20 wherein said oxidation process is performed under pressure.

22. The method of claim 21 wherein said gaseous product stream includes nitrogen and water vapor.

23. The method of claim 22 wherein said oxidation process is an aqueous process.

24. The method of claim 7 wherein said lubricant is combustible.

25. The method of claim 9 further including restricting said outlet means for limiting the rate of removal of seal gas from the chamber and thereby controlling the rate of injection of seal gas into the seal means.

* * * * *